United States Patent [19]

Perry

[11] 4,122,600

[45] Oct. 31, 1978

[54] INJECTOR RAZOR ADAPTER

[75] Inventor: Roger L. Perry, Lynnfield Center, Mass.

[73] Assignee: The Gillette Company, Boston, Mass.

[21] Appl. No.: 816,934

[22] Filed: Jul. 19, 1977

[51] Int. Cl.[2] ..... B26B 21/40

[52] U.S. Cl. ..... 30/90

[58] Field of Search ..... 30/40.2, 90; 206/352, 206/359; 29/239; 221/232

[56] References Cited

U.S. PATENT DOCUMENTS

| | | | |
|---|---|---|---|
| 2,256,543 | 9/1941 | Auerbach | 30/40.2 |
| 2,436,026 | 2/1948 | Steinbach | 30/40.2 |
| 3,419,959 | 1/1969 | Lively | 30/90 |

*Primary Examiner*—Gary L. Smith

*Attorney, Agent, or Firm*—Richard A. Wise; Scott R. Foster

[57] ABSTRACT

An adapter for injector razors comprising a substantially rigid one-piece tool insertable in the head of an injector-type razor and operable to open the head of the razor such that a used blade therein may be released and a new blade manually inserted.

2 Claims, 1 Drawing Figure

INJECTOR RAZOR ADAPTER

BACKGROUND OF THE INVENTION

1. Field of the Invention

This invention relates to injector razors and is directed more particularly to an adapter facilitating the release of a used blade from an injector razor and the manual insertion of a new blade.

2. Description of the Prior Art

In the injector razor art, it is commonplace to provide a blade dispenser in the form of a magazine containing a plurality of injector razor blades. Generally, the dispenser is provided with a bayonet portion which is insertable in the head of the injector razor in such manner as to open the head and permit the movement of a blade from the dispenser into the head, thereby causing discharge of the old used blade out of the head of the razor.

It is believed that injector-type razors might find wider acceptability, particularly in lesser developed countries, if it were not necessary to purchase blades in multiples of five, ten, etc. It is believed that a wider market for this type of shaving system might be available if blades were made available to the purchasing public singly. Of course, providing a complete dispenser with a single blade would, in large measure, negate the economies of purchase of a single blade.

SUMMARY OF THE INVENTION

It is therefor an object of the present invention to provide an adapter by which an operator may manually insert a single injector-type razor blade into an injector razor and release the used blade therefrom.

A further object of the invention is to provide such a device which is simple in construction, easy to use, and inexpensive to manufacture.

With the above and other objects in view, as will hereinafter appear, a feature of the present invention is the provision of an adapter for injector razors comprising a substantially rigid one-piece tool including a bayonet portion for insertion in a head portion of an injector razor, an elongated lever portion extending generally parallel to the bayonet portion but removed therefrom, and means interconnecting the bayonet portion and the lever portion, the lever portion including means for engaging the injector razor head, the lever portion further including pusher means whereby the lever portion may be manually manipulated by an operator.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention from which its novel features and advantages will be apparent.

DESCRIPTION OF THE PREFERRED EMBODIMENT

Figure 1:
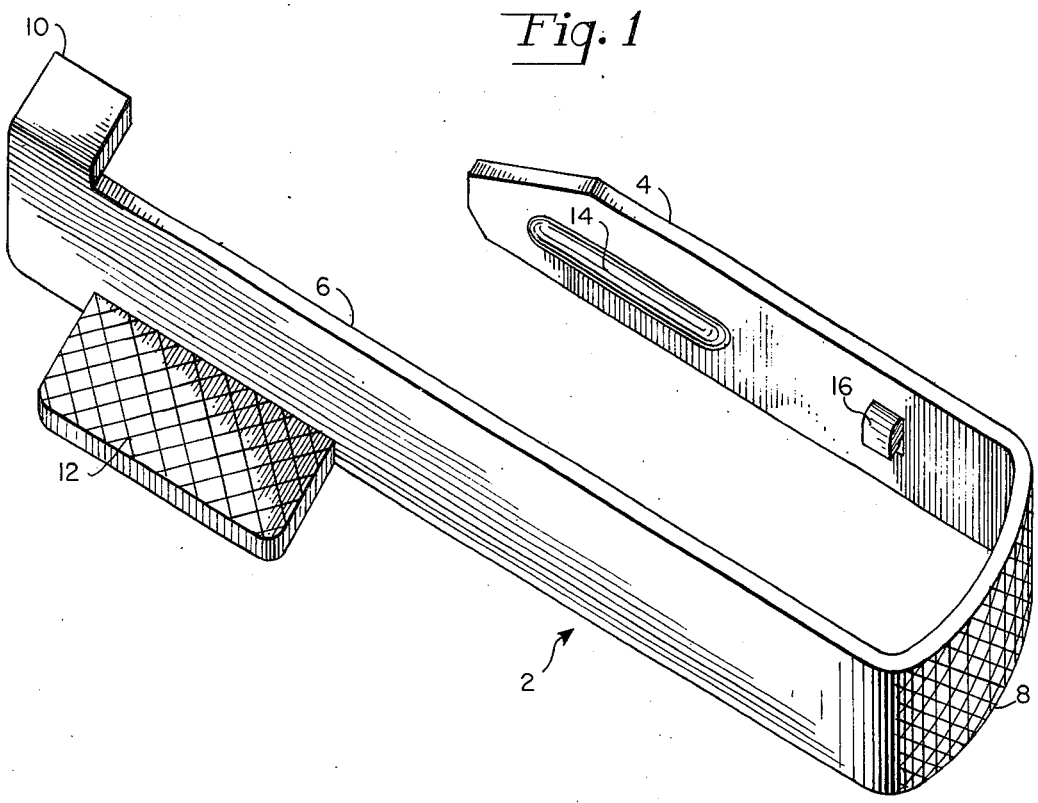
FIG. 1 is a perspective view of one form of adapter illustrative of an embodiment of the invention.

Referring to FIG. 1, it will be seen that the illustrative device comprises a substantially rigid one-piece tool 2 having a bayonet portion 4 for insertion into a head portion of an injector razor (not shown). The device is further provided with an elongated lever portion 6 extending generally parallel to the bayonet portion 4 but removed therefrom. The bayonet portion 4 and the lever portion 6 are connected by an end portion 8. The bayonet portion 4, the lever portion 6 and the end portion 8 are cooperatively of a U-configuration edge-wise, as shown in FIG. 1.

The lever portion 6 is provided at its free end with an inwardly directed tab 10 which, when the device is in place on a injector razor head, overlies a guard portion of the razor. The lever portion 6 is further provided with a pusher member 12 which is adapted to be manipulated manually by an operator, as will be further described below.

The bayonet portion 4 is provided with an elongated cam portion 14 which, when the bayonet portion 4 is inserted into an injector razor head, operates to separate the razor cap portion from the razor platform portion by urging the platform portion forwardly of the cap portion. The bayonet portion 4 is further provided with an inwardly extending detent 16 which engages a surface of the razor head and causes further separation of the platform and cap members of the razor, by urging the platform downwardly of the cap portion, particularly in the vicinity of the end portion 8.

Depression of the pusher member 12, with the tool in place in a razor head, causes the tab member 10 to engage an upper surface of the razor guard and urge the guard downwardly, thereby causing separation of the cap and platform portions of the razor head in the vicinity of the tab 10.

In operation, one desiring to change blades in an injector-type razor and having a single blade to insert manually, would first enter the bayonet portion 4 of the device into the head of the razor in the same manner in which one ordinarily introduces the bayonet portion of an injector dispenser into the head of an injector razor. Entry of the bayonet portion into the razor causes separation of the cap portion and platform portion of the razor, the cam portion 14 wedging the two razor portions apart near the mid-point of the razor, and the detent 16 causing and maintaining separation of the two razor components near a first end of the razor. Depression of the pusher member 12 by the operator causes like depression of the tab member 10 which in turn causes separation of the platform member from the cap member at a second end of the razor head. With the cap and platform portions of the razor thus separated throughout their length, the included used razor blade will probably drop from the razor head. The operator holding a new blade may insert the new blade in the head of the razor, between the separated cap and guard and platform components. In the event the old blade has not dropped out of the razor head, the entry of the new blade at the first end of the razor will force the old blade out the second end of the razor head.

The device of the present invention is preferably of a rigid material, such as metal or rigid plastic.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. An adapter for injector razors comprising a one-piece tool including a bayonet portion adapted for insertion into a head portion of an injector razor, an elongated level portion comprising a substantially planar portion extending in a plane generally parallel to a plane of said bayonet portion but removed therefrom, an end portion interconnecting said bayonet portion and said lever portion, said bayonet portion, said lever portion and said end portion being cooperatively of a U-configuration edge-wise, said lever portion including tab means disposed at a free end of said lever portion and extending generally normally of said lever portion and towards said plane of said bayonet portion from an edge of said lever portion, said tab means being operable to engage a platform portion of said razor to urge said platform portion to a position separated from a cap portion of said razor, and pusher means comprising a projection extending from said lever portion in a direction opposite from said bayonet portion and having a surface generally normal to said plane of said lever portion, whereby said pusher means may be manipulated by an operator to cause said tab means to urge said platform portion to said position separated from said cap portion.

2. The invention according to claim 1 in which said bayonet portion includes cam means for separating cap and platform portions of said injector razor head.

* * * * *